US006789317B1

(12) United States Patent
Sohal et al.

(10) Patent No.: US 6,789,317 B1
(45) Date of Patent: Sep. 14, 2004

(54) FINNED TUBE WITH VORTEX GENERATORS FOR A HEAT EXCHANGER

(75) Inventors: Monohar S. Sohal, Idaho Falls, ID (US); James E. O'Brien, Idaho Falls, ID (US)

(73) Assignee: Bechtel BWXT Idaho, LLC, Idaho Falls, ID (US)

( * ) Notice: Subject to any disclaimer, the term of this patent is extended or adjusted under 35 U.S.C. 154(b) by 0 days.

(21) Appl. No.: 10/463,901

(22) Filed: Jun. 17, 2003

(51) Int. Cl.[7] ..... B23P 15/26

(52) U.S. Cl. ..... 29/890.046; 29/890.03; 29/890.048

(58) Field of Search ..... 29/890.046, 557, 29/890.035, 890.045, 890.048, 890.07, 428; 165/183, 110, 181, 182, 151, 109.1

(56) References Cited

U.S. PATENT DOCUMENTS

| | | | | | |
|---|---|---|---|---|---|
| 1,416,570 | A | * | 5/1922 | Modine | 165/151 |
| 4,279,298 | A | * | 7/1981 | Lee | 165/181 |
| 4,284,133 | A | | 8/1981 | Gianni et al. | |
| 4,787,442 | A | * | 11/1988 | Esformes | 165/151 |
| 4,817,709 | A | * | 4/1989 | Esformes | 165/151 |
| 4,959,985 | A | | 10/1990 | Kuroda et al. | |
| 4,984,626 | A | | 1/1991 | Esformes et al. | |
| 4,997,036 | A | * | 3/1991 | Schulze et al. | 165/182 |
| 5,092,038 | A | | 3/1992 | Geppelt et al. | |
| 5,361,828 | A | * | 11/1994 | Lee et al. | 165/109.1 |
| 5,704,417 | A | * | 1/1998 | Christensen et al. | 165/110 |
| 6,349,761 | B1 | | 2/2002 | Liu et al. | |
| 6,578,627 | B1 | * | 6/2003 | Liu et al. | 165/109.1 |
| 6,636,423 | B2 | * | 10/2003 | Rinella et al. | 361/703 |

FOREIGN PATENT DOCUMENTS

| | | | |
|---|---|---|---|
| EP | 0430852 A1 | * | 6/1991 |
| GB | 2088544 A | * | 6/1982 |
| KR | 2002026974 A | * | 4/2002 |
| KR | 2001087651 A | * | 12/2002 |

OTHER PUBLICATIONS

O'Brien, James E. et al., "Local Heat Transfer For Finned–Tube Heat Exchangers Using Oval Tubes" National Heat Transfer Conference, Pittsburgh, Aug. 2000.

O'Brien, James E. et al., "Heat Transfer Enhancement for Finned–Tube Hear Exchangers with Winglets" Proceedings of IMECE'00, 2000 International Mechnical Engineering Congress and Exposition, Orlando, FLA, Nov. 5–10, 2000.

Foust, Thomas D. et al., "Numerical and Experimental Methods for Heat Transfer Enhancement for Finned–Tube Heat Exchangers With Oval Tubes", National Heat Transfer Conference, Anaheim, CA, Jun. 2001.

Sohal, M.S. et al., "Improving Air–Cooled Condenser Performance Using Winglets And Oval Tubes In A Geothermal Power Plant", GRC Annual Meeting, San Diego, CA Aug. 2001.

O'Brien, James E. et al., "Local Heat Transfer And Pressure Drop For Finned–Tube Heat Exchangers Using Oval Tubes And Vortex Generators", 2001 ASME International Congress and Exhibition, New York, Nov. 2001.

* cited by examiner

*Primary Examiner*—Irene Cuda-Rosenbaum
(74) *Attorney, Agent, or Firm*—Klaas Law O'Meara & Malkin

(57) ABSTRACT

A system for and method of manufacturing a finned tube for a heat exchanger is disclosed herein. A continuous fin strip is provided with at least one pair of vortex generators. A tube is rotated and linearly displaced while the continuous fin strip with vortex generators is spirally wrapped around the tube.

4 Claims, 6 Drawing Sheets

FINNED TUBE WITH VORTEX GENERATORS FOR A HEAT EXCHANGER

CONTRACTUAL ORIGIN OF THE INVENTION

This invention was made with United States Government support under contract number DE-AC07-99ID13727, awarded by the United States Department of Energy. The United States Government has certain rights to the invention.

FIELD OF THE INVENTION

The present invention relates generally to finned tube heat exchangers, and more particularly to a finned tube for a heat exchanger having vortex generators on the fins thereof.

BACKGROUND OF THE INVENTION

Most large-scale heat exchangers, such as the air-cooled condensers used in binary-cycle geothermal power plants, require the use of finned tubes in order to increase the heat transfer surface area. A finned tube in a heat exchanger is generally comprised of a tube with a series of fins extending from the outer surface of the tube along its length. Such fins may be plate-type individual fins or wound in a spiral-type configuration along the length of the tube. In a condenser such as an air-cooled condenser, coolant such as air is typically forced through several rows (or a "bundle") of long, individually-finned tubes by large induced-draft fans or the like. The condenser units in a power plant can be very large and represent a significant percentage of the overall capital cost of the plant. In addition, the power required to operate the fans typically represents a significant parasitic house load, thereby reducing the net power production of the power plant. Therefore, it would be generally desirable to increase the heat transfer performance of the finned tubes without significantly increasing the cost of the condenser or the power required to operate the fans.

Generating counter-rotating longitudinal vortices in the fluid flow path along the finned tube periphery results in a more efficient exchange of heat. This is due at least in part to the fact that longitudinal vortices disrupt boundary layer formation and mix the fluid (e.g., air) stream near the fin and tube surfaces with the main fluid flow stream. Certain longitudinal vortices, called "horseshoe vortices", are generated naturally in finned tube heat exchanger passages by the interaction of the fluid flow with the curved surface of a heat exchanger tube. The heat transfer performance of finned tubes can be further improved by generating additional longitudinal vortices, which can be created through the use of vortex generators on the individual fins.

Vortex generators may be comprised of a series of winglets mounted on or punched into the fin surfaces. Depending on the shape of the winglets and the position of the winglets on the fins, heat transfer performance can be significantly improved with a minimal increase in pressure drop along the finned tube.

SUMMARY OF THE INVENTION

The present invention is directed to a method of manufacturing a finned tube for a heat exchanger. A continuous fin strip and a tube are provided. The tube has a wall with a continuous cross-sectional shape, an internal surface and an external surface. At least one pair of vortex generators is produced in the fin strip. This may be accomplished by punching at least one pair of winglets out of the continuous fin strip, thereby producing corresponding openings in the continuous fin strip. Each of the winglets has at least one folded edge such that it extends from a surface of the continuous fin strip adjacent to its corresponding opening. Concurrently with and subsequent to producing the vortex generators in the continuous fin strip, the tube is rotated and linearly displaced while the continuous fin strip with vortex generators is spirally wrapped around the external surface of the tube. This results in producing at least one pair of vortex generators on each 360-degree section of continuous fin strip.

The present invention is also directed to a system for manufacturing a finned tube for a heat exchanger. The system includes a continuous fin strip and a vortex generator die assembly operatively connected thereto. The vortex generator die assembly is adapted to produce at least one pair of vortex generators in the continuous fin strip, thereby creating a continuous fin strip with vortex generators. The vortex generator die assembly may comprise a male punch having at least one pair of tapered protrusions and a female die having at least one pair of indentations corresponding to and adapted to receive the protrusions of the male punch. The vortex generator die assembly is adapted to punch at least one pair of winglets out of the continuous fin strip, thereby producing corresponding openings in the continuous fin strip. Each of the winglets may have at least one folded edge such that each of the winglets extends generally perpendicularly from a front surface of the continuous fin strip adjacent to one of the corresponding openings. The system also includes a tube assembly having a tube holding device. Operatively connected to the tube holding device are a rotating device and a linear displacement device. A tube held by the tube holding device is rotated by the rotating device and linearly displaced by the linear displacement device while the continuous fin strip with vortex generators is spirally wrapped around the tube, thereby producing at least one pair of vortex generators on each 360-degree section of continuous fin strip.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
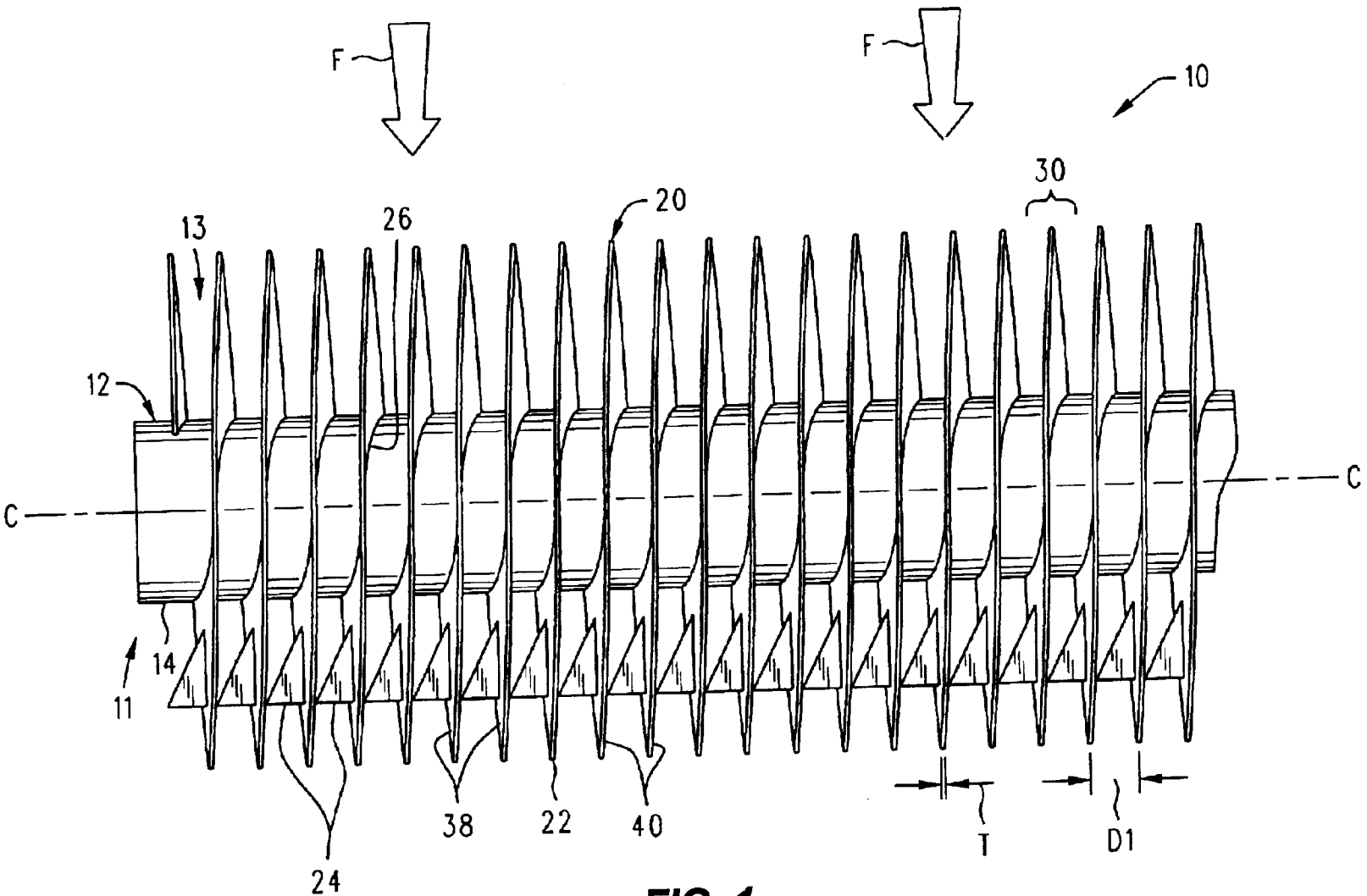
FIG. 1 is an isometric view of a spirally-wound finned tube with vortex generators.
Figure 2:
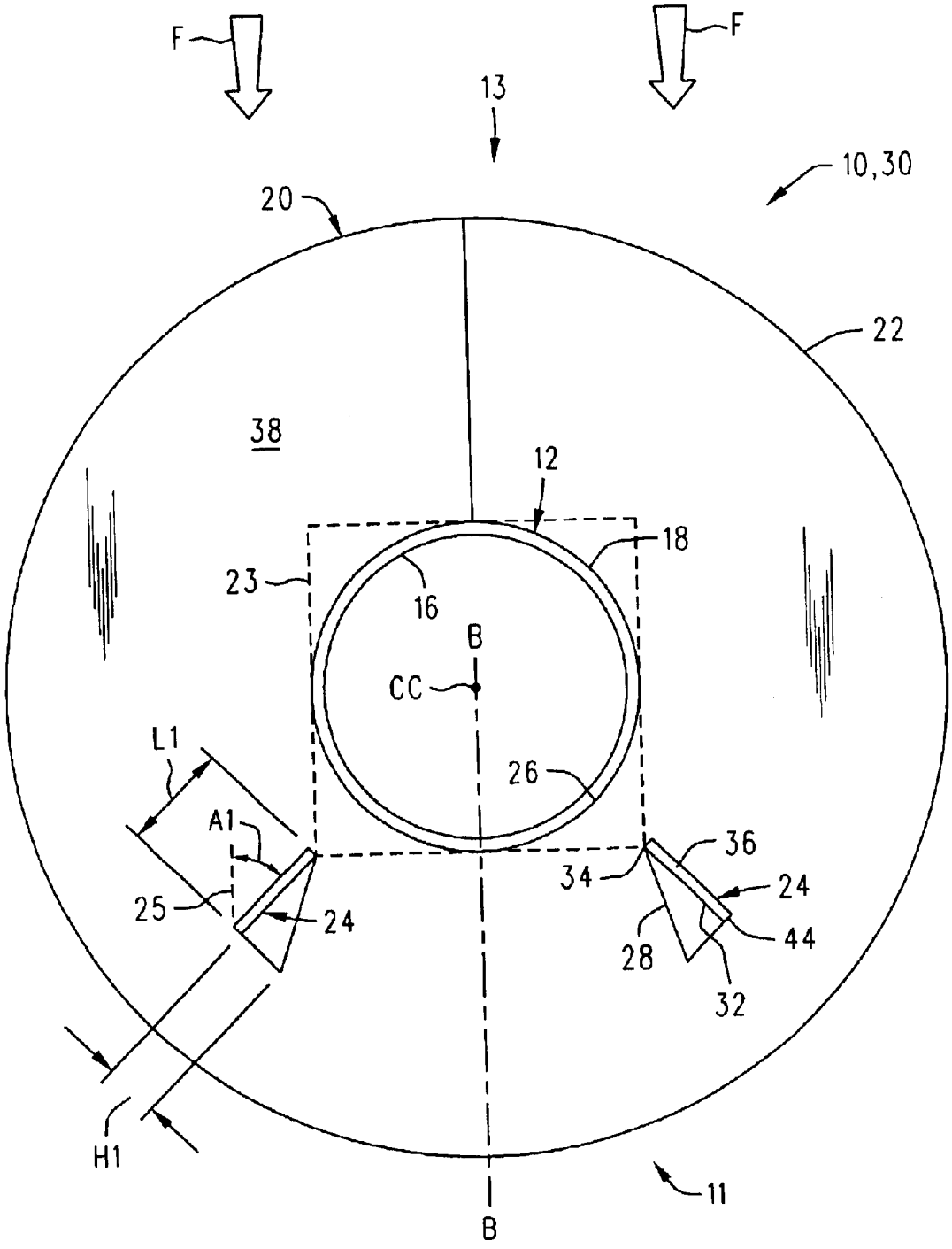
FIG. 2 is a front elevation view of the spirally-wound finned tube of FIG. 1 showing a first type of vortex generators.
Figure 3:
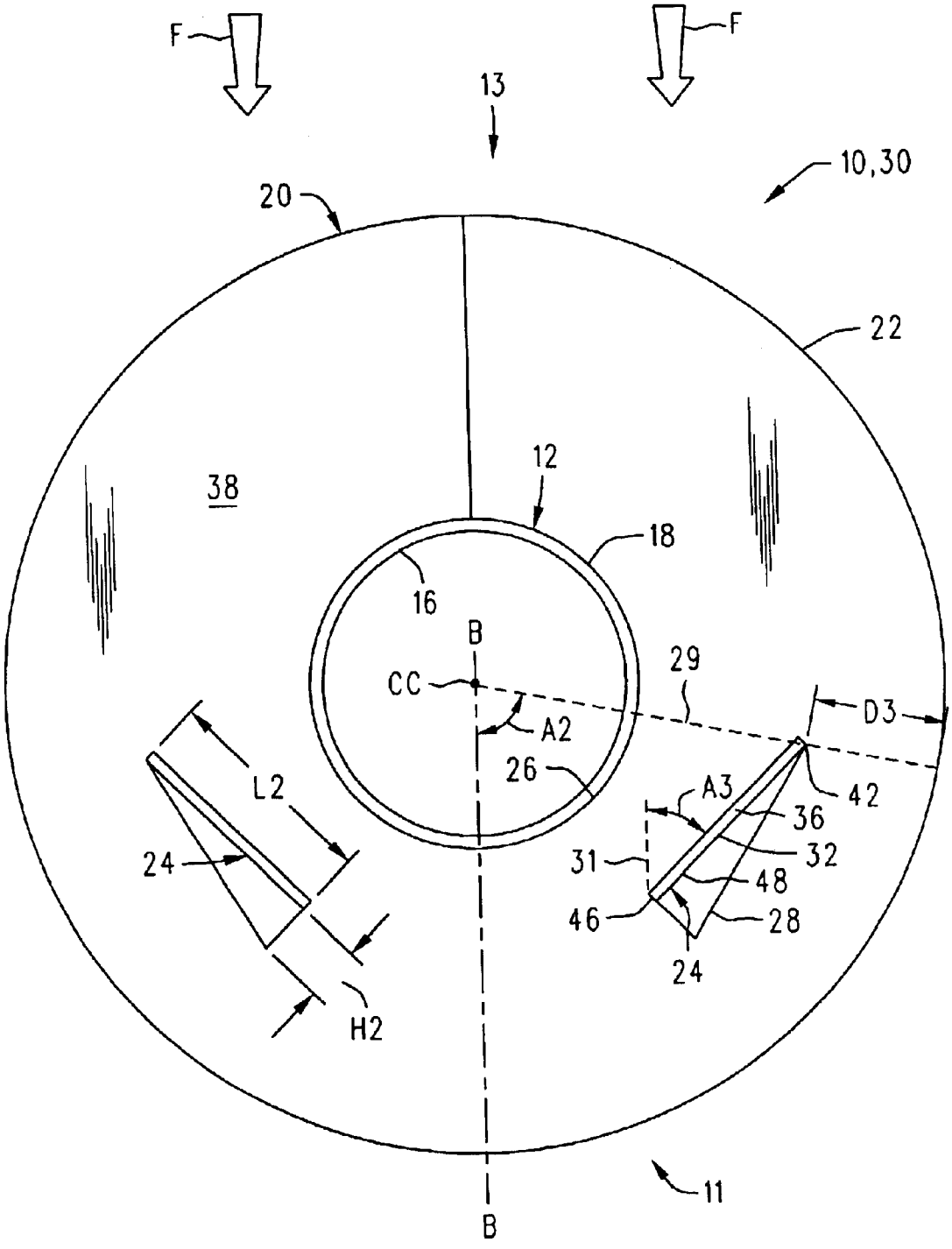
FIG. 3 is a front elevation view of the spirally-wound finned tube of FIG. 1 showing another type of vortex generators.

FIGS. 1–3 illustrate a spirally-wound finned tube 10 from a finned tube heat exchanger (not shown). The spirally-wound finned tube 10 comprises an elongate tube 12 having a central longitudinal axis "CC" and a wall 14 with a continuous cross-sectional shape which may be circular, as shown, oval, or any other shape utilized in finned tube heat exchangers. As best shown in FIGS. 2–3, the wall 14 of the elongate tube 12 has an inner surface 16 and an outer surface 18. Wound around the outer surface 18 of the elongate tube 12 in a spiral configuration is a continuous fin strip 20. The fin strip 20 has a vortex generators 24 thereon which are preferably produced on the fin strip 20 prior to spirally winding it around the elongate tube 12, as described in further detail below.

The fin strip 20 may be aluminum or any other material of suitable thickness commonly used in finned tube heat exchangers. Specifically, the fin strip 20 may have a thickness "T", FIG. 1, of between about 0.010 inch and 0.020 inch, and most preferably about 0.016 inch. The fin strip 20 should be relatively easily deformable into a spiral configuration in that, when the fin strip 20 is wound around the tube 12, the portions of the fin strip 20 closer to its outer circumference 22 will stretch more than the portions closer to its inner circumference 26. The fin strip 20 may be attached to the elongate tube 12 at its inner circumference 26 in any manner such as, for example, by cutting a narrow groove (not shown) in the tube 12 outer surface 18 and inserting the fin strip 20 into the groove, or bending the fin strip 20 to form a "collar" (not shown) which is then attached to the tube 12 outer surface 18.

Figure 4:
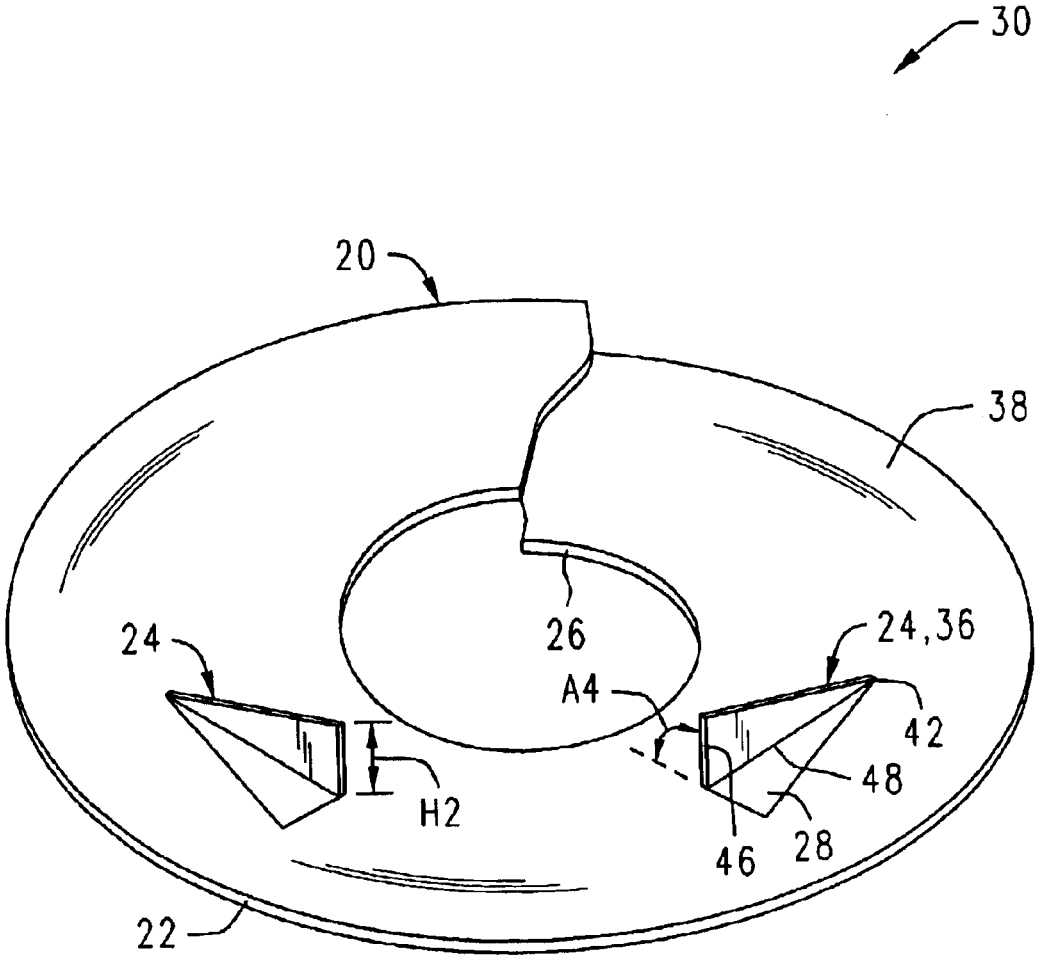
FIG. 4 is an isometric view of a 360-degree section of a spirally-wound fin strip with vortex generators of FIG. 3.

Referring to FIGS. 2–4, the vortex generators 24 may be produced on the fin strip 20 by punching out a portion of the fin strip 20, thereby leaving an opening 28 in the fin strip 20. The portion of the fin strip 20 which is punched out may then be bent or folded at an edge (e.g., 32, FIG. 2; 48, FIG. 3) thereof away from a front surface 38 of the fin strip 20 to produce a winglet 36 having substantially the same shape as the opening 28 in the fin strip 20. The winglet 36 may extend at an angle "A4", FIG. 4, from the front surface 38 of the fin strip 20 adjacent to its opening 28 as best shown in FIG. 4. The angle "A4" may be any angle, but is most preferably approximately 90 degrees so that the winglet 36 extends generally perpendicularly from the front surface 38 of the fin strip 20. The winglet 36 is generally considered to be the "vortex generator" since the winglet 36 extending from the front surface 38 of the fin strip 20 generates counter-rotating longitudinal vortices in the fluid flow path "F" along the finned tube 10. Thus, as used herein, the terms "vortex generator" and "winglet" may be used interchangeably.

It is to be understood that the vortex generators 24 shown in FIGS. 1–4 are examples of two specific designs, and the number of vortex generators 24, as well as the shape, configuration, and position of each vortex generator 24 on the fin strip 20, can be varied if specific application requires such a change. More specifically, a vortex generator winglet 36 and its corresponding opening 28 may each have a generally triangular shape as shown in FIGS. 2–4 or may have a different shape such as, for example, rectangular (not shown). Furthermore, vortex generators 24 (or pairs of vortex generators) of different shapes and configurations may be provided. The position of the vortex generators 24 on the fin strip 20 may also vary. For example, as illustrated in FIGS. 1–3, the vortex generators 24 may be positioned on the fin strip 20 such that, after the fin strip 20 is wound around the tube 12, the vortex generators 24 are positioned along the "downstream" side 11 of the finned tube 10. The "downstream" side 11 of the finned tube 10 is defined herein as being opposite to the "upstream" side 13 facing the source (not shown) of the fluid flow "F", FIGS. 1–3. Alternately or in addition, the vortex generators 24 may be placed on the "upstream" side 13 of the finned tube 10. As best shown in FIG. 1, each vortex generator 24 may be adjacent to (which is defined herein as either contacting or not quite contacting) the rear surface 40 of the next adjacent portion of fin strip 20 in order to provide support to the fin strip 20 as well as even spacing between each 360-degree section 30 of fin strip 20. The term "360-degree section" 30 of fin strip 20 as used herein and as shown in FIGS. 2–4 is defined as a section of fin strip 20 that is wound entirely around the tube, regardless of the tube cross-sectional shape (circular, oval, etc.). As best shown in FIGS. 2–4, the vortex generators 24 preferably consist of at least one pair of winglets 36 on each 360-degree section 30 of fin strip 20. As shown in FIGS. 2 and 3, the winglets 36 are preferably positioned in mirror-image relation to one another across a radial axis "BB" extending across the front surface 38 of the fin strip 20. As noted above, more pairs of vortex generators/winglets may be added to each 360-degree section 30 of fin strip 20 as desired.

A mirror-image pair of vortex generators 24 is shown in FIG. 2, which illustrates a 360-degree section 30 of fin strip 20. The vortex generators 24 of FIG. 2 may be referred to as "toe-out" winglets or vortex generators. These vortex generators 24, FIG. 2, may be generally triangular and, more specifically, a right triangle as shown. The smallest edge 44 of each winglet 36 has a height "H1", which is the same as the width of the corresponding opening 28 as indicated in FIG. 2. The folded edge 32 of each winglet 36 has a length "L1" which may be equal to approximately 2×H1. The height "H1" may be equal to approximately 0.9 times the distance "D1", FIG. 1, separating adjacent 360-degree sections 30 of fin strip 20 such that each vortex generator 24 may be adjacent to (which is again defined herein as either contacting or not quite contacting) the rear surface 40 of a portion of fin strip 20 as noted above and shown in FIG. 1. For example, for a finned tube 10 having ten to nine fins per inch of tube length, the corresponding distance "D1" between each 360-degree section 30 of fin strip 20 would be approximately 0.1 to 0.11 inch. In this example, the height "H1", FIG. 4, of each vortex generator 24 may be approximately 0.09 to 0.1 inch, and the length "L1" of the folded edge 32 of each vortex generator 24 may be approximately 0.18 to 0.2 inch. As shown in FIG. 2, the innermost corners 34 of the openings 28 may be aligned with two corners of the smallest square 23 which encloses the circle corresponding to the inner circumference 26 of the fin strip 20. An angle "A1" between a line 25 parallel to a radial axis "BB" (which extends across the front surface 38 of the fin strip 20) and the folded edge 32 of the winglet 36 may be between approximately 45 degrees. As shown in FIG. 2, each of the winglets 36 may be oriented generally toward the central longitudinal axis "CC" of the tube 12.

Another mirror-image pair of vortex generators 24 is shown in FIGS. 3 and 4, which each illustrate a 360-degree section 30 of fin strip 20. The vortex generators 24 of FIGS. 3 and 4 may be referred to as "toe-in" winglets or vortex generators. These vortex generators 24 may also be triangular (and, more specifically, a right triangle as shown). The smallest edge 46 of each winglet 36 has a height "H2", FIG. 4, which is the same as the width of the corresponding opening 28. The folded edge 48 of each winglet 36 has a length "L2" which may be equal to approximately 4×H2. Like the embodiment shown in FIG. 2, the height "H2" of each winglet 36 shown in FIGS. 3 and 4 may be equal to approximately 0.9 times the distance "D1", FIG. 1, separating adjacent 360-degree sections 30 of fin strip 20 such that each vortex generator 24 may be adjacent to (which is again defined herein as either contacting or not quite contacting) the rear surface 40 of a portion of fin strip 20 as noted above and shown in FIG. 1. In the above example whereby a finned tube 12 has ten to nine fins per inch of tube length making the distance "D1" approximately 0.1 to 0.11 inch, the height "H2" of each vortex generator 24 may be approximately 0.09 to 0.1 inch, and the length "L2" of the folded edge 48 of each winglet 28 may be approximately 0.36 to 0.4 inch. An angle "A2" between the radial axis "BB" and a line 29 from the smallest-angle corner 42 of an opening 28 to the center of the tube at a point where axes "BB" and "CC" intersect may be approximately 67.5 degrees. With an angle "A2" of approximately 67.5 degrees, the distance "D3", FIG. 3, from the smallest-angle corner 42 of each opening 28 to the closest point on the outer circumference 22 of the fin strip 20 may be approximately 0.318 inch. Like the embodiment of FIG. 2, an angle "A3", FIG. 3, between a line 31 parallel to axis "BB" (which extends across the front surface 38 of the fin strip 20) and the folded edge 32 of the winglet 36 may be approximately 45 degrees. As shown in FIG. 3, each of the winglets 36 may be oriented generally perpendicularly to the central longitudinal axis "CC" of the tube 12.

Considering heat transfer performance only, the heat transfer coefficient on the outer surface of the tube using finned tubes with winglets such as those shown in FIGS. 2 and 3 and described above can go up by approximately 30% compared to a baseline finned tube without winglets at air velocity typical of air-cooled condensers. However, increased heat transfer performance is generally accompanied by an increase in pressure drop. By utilizing the above winglets shown in FIGS. 2 and 3, the ratio of increase in heat transfer coefficient and increase in pressure drop is maximize.

Figure 5:
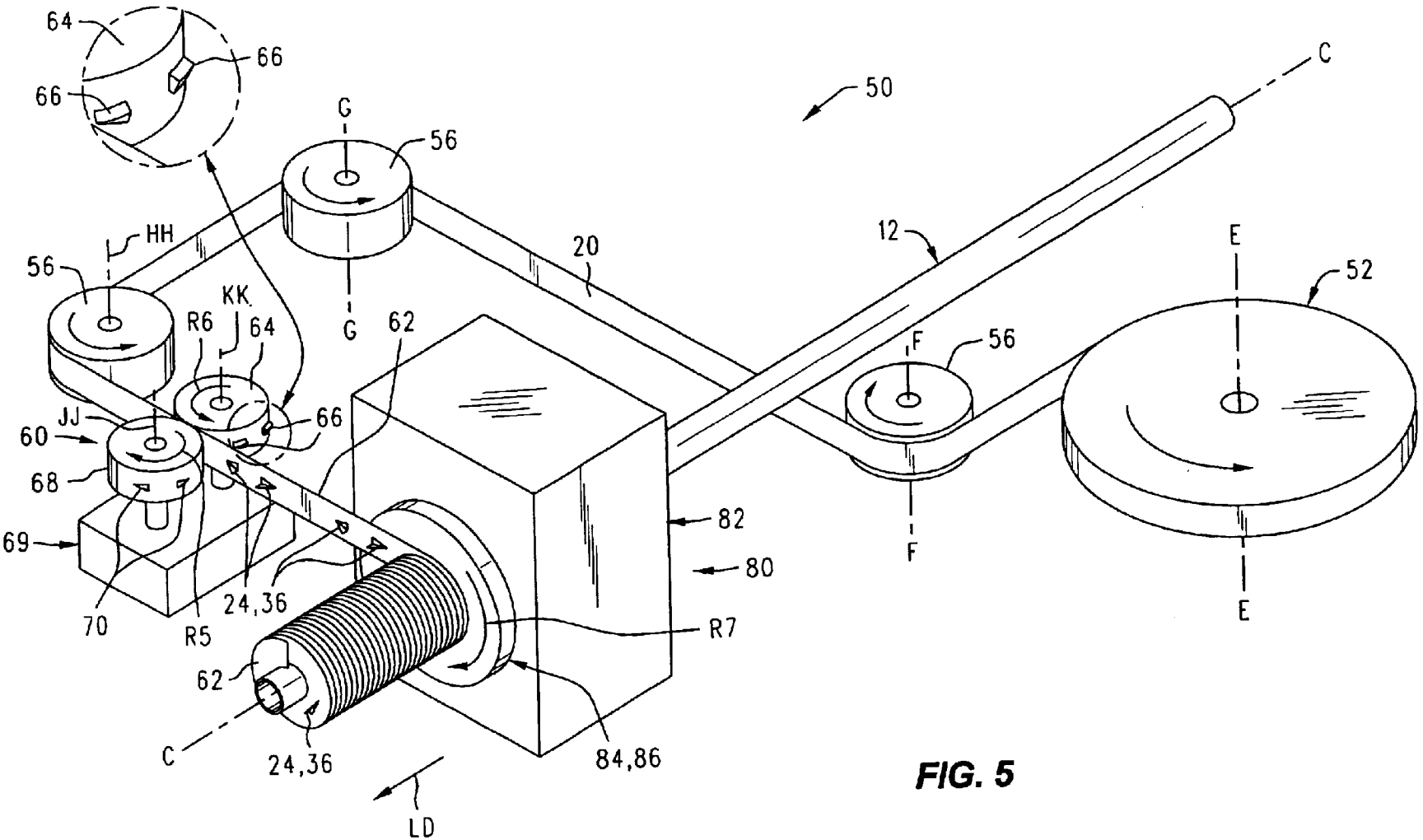
FIG. 5 is a schematic view of a system for manufacturing the spirally-wound finned tube of FIGS. 1–4.

A system 50 for manufacturing a finned tube 10 for a heat exchanger (not shown) is illustrated in FIG. 5. The system 50 may comprise a supply 52 of fin material (which may be aluminum, as discussed above) that may be unwound in a first rotational direction "R1" around a central axis "EE" to provide a continuous fin strip 20. The system 50 may further comprise one or more idler rolls 56 which are adapted to rotate a rotational direction "R2", "R3", or "R4" around their central axes "FF", "GG", or "HH", respectively, in order to guide and operatively connect the continuous fin strip 20 to a vortex generator die assembly 60. The vortex generator die assembly 60 is adapted to produce at least one pair of vortex generators 24 in the continuous fin strip 20, thereby creating a continuous fin strip with vortex generators 62.

As shown in FIG. 5, the vortex generator die assembly 60 may comprise a male punch 64 having at least one pair of protrusions 66 which are equal in size and also in number to the desired vortex generators 24 on a 360-degree section 30 of fin strip 20 (as shown in FIGS. 2–4, for example). As shown in the enlarged view of the male punch 64 in FIG. 5, the protrusions 66 may be tapered in order to form the winglets 36 and folded edges 32, FIGS. 2–4. The male punch 64 may be connected to a motor assembly 69 adapted to rotate the male punch 64 in a rotational direction "R5" around a central axis "JJ". A female die 68 may also be provided having at least one pair of indentations 70 corresponding to and adapted to receive the protrusions 66 on the male punch 64. The female die 68 may also be connected to a motor assembly 69 adapted to rotate the female die 68 in a rotational direction "R6" (which is opposite to rotational direction "R5") around a central axis "KK".

As shown in FIG. 5, the system 50 may further comprise a tube assembly 80. The tube assembly 80 may comprise a tube holding device 82 adapted to hold a tube 12 in a position which is generally lateral to the continuous fin strip with vortex generators 62. Operatively connected to the tube holding device 82 are a rotating device 84 and a linear displacement device 86. The rotating device 84 is adapted to rotate the tube 12 in a rotational direction "R7" around its central longitudinal axis "CC", and the linear displacement device 82 is adapted to concurrently displace a tube 12 in a linear direction "LD". The rotating device 84 and linear displacement device 86 may be a single assembly operated by a single motor (not shown) within the tube holding device 82. The continuous fin strip with vortex generators 62 may be attached to the tube 12 in any desired manner as discussed above. After initially attaching the material 62 to the tube 12, the tube 12 is rotated and linearly displaced, thereby spirally wrapping the continuous fin strip with vortex generators 62 around the tube 12.

Figure 6:
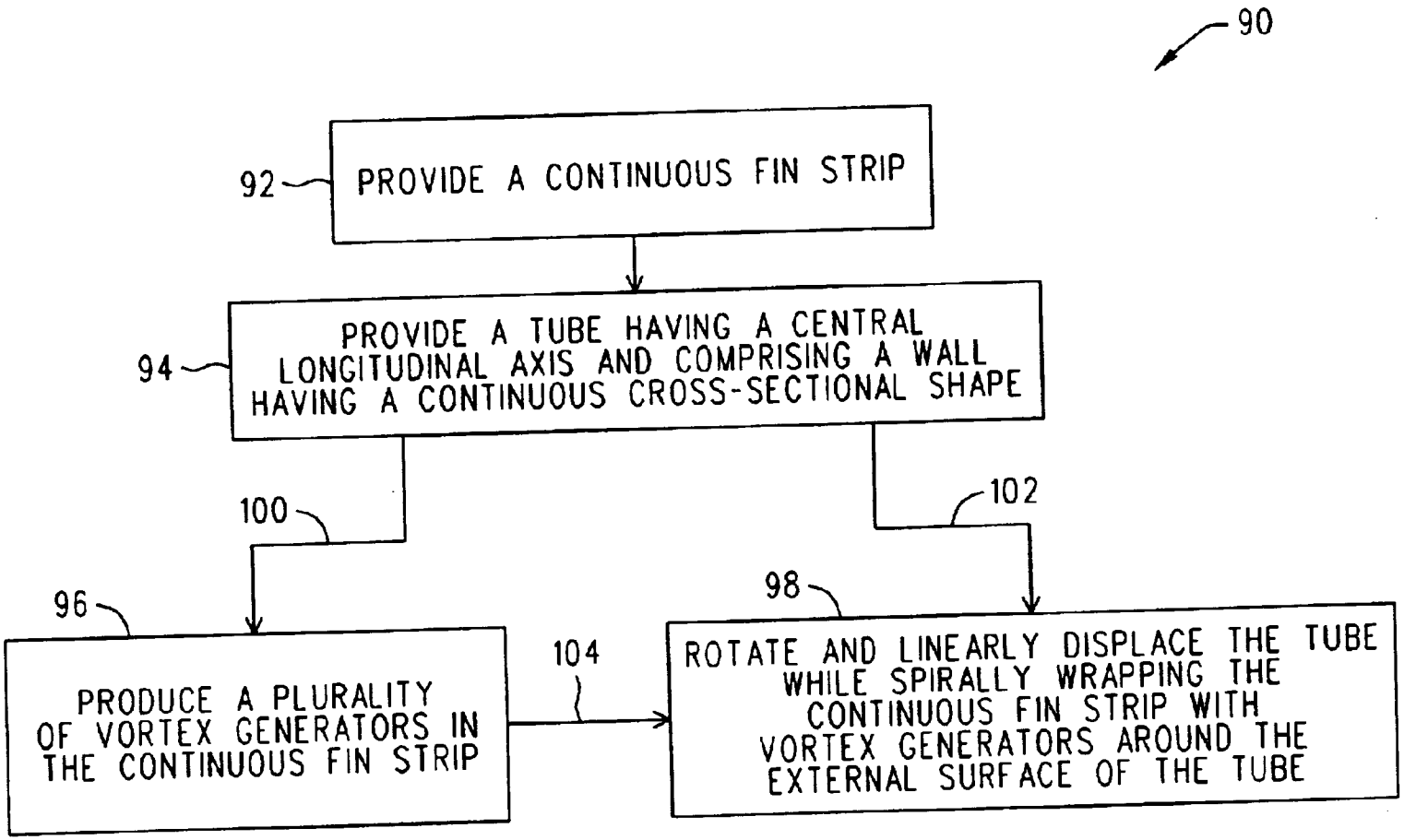
FIG. 6 is a block diagram illustrating a method of manufacturing the spirally-wound finned tube of FIGS. 1–4.

With reference also to FIGS. 1–5, a method 90 of manufacturing a finned tube 10 for a heat exchanger (not shown) is illustrated in FIG. 6. The method 90 may comprise a first step 92 of providing a continuous fin strip 20. The next step 94 involves providing a tube 12 having a central longitudinal axis "CC" and comprising a wall 14 having a continuous cross-sectional shape such as, for example, a circular or oval shape. As described above, the wall 14 has an internal surface 16 and an external surface 18. The next step 96 involves producing at least one pair of vortex generators 24 in the fin strip 20, thereby creating a continuous strip of fin strip with vortex generators 62. As described above, the vortex generators may be produced by punching at least one pair of winglets 36 out of the fin strip 20, thereby producing corresponding openings 28 in the fin strip. Also as described above, each of the winglets 36 comprises at least one folded edge 32 such that each of the winglets 36 extends at an angle, and most preferably generally perpendicularly as noted above, from a front surface 38 of the fin strip 20 adjacent to one of the corresponding openings 28. The next step 98 is performed concurrently with and subsequent to the previous step 96, as indicated by the arrows 100, 102 (which indicate concurrent performance of steps 96 and 98) and arrow 104 (which indicates performance of step 98 subsequent to step 96). This step 98 may involve linearly displacing and rotating the tube 12 while spirally wrapping the continuous fin strip with vortex generators 62 around the external surface 18 of the tube 12, thereby producing at least one pair of vortex generators on each 360-degree section of continuous fin strip as shown in FIGS. 2–4.

While illustrative and presently preferred embodiments of the invention have bee described in detail herein, it is to be understood that the inventive concepts may be otherwise variously embodied and employed and that the appended claims are intended to be construed to include such variations except insofar as limited by the prior art.

We claim:

1. A method of manufacturing a finned tube for a heat exchanger, comprising:

providing a continuous fin strip;

providing a tube having a central longitudinal axis and comprising a wall having a continuous cross-sectional shape, said wall having an internal surface and an external surface;

producing at least one pair of vortex generators in said continuous fin strip, thereby creating a continuous fin strip with vortex generators, comprising:

punching at least one pair of winglets out of said continuous fin strip, thereby producing corresponding openings in said continuous fin strip;

wherein each of said winglets comprises a folded edge such that each of said winglets extends generally perpendicularly from a front surface of said continuous fin strip adjacent to one of said corresponding openings;

concurrently with and subsequent to said producing said vortex generators in said continuous fin strip, rotating and linearly displacing said tube while spirally wrapping said continuous fin strip with vortex generators around said external surface of said tube, thereby producing said at least one pair of vortex generators on each 360-degree section of said continuous fin strip.

2. The method of claim 1, each of said vortex generators in a pair of vortex generators being mirror images of one another across a radial axis which extends across said front surface of said continuous fin strip, each of said vortex generators comprising:

a winglet having a generally triangular shape and extending generally perpendicularly from said front surface of said continuous fin strip, said winglet being oriented generally perpendicularly to said central longitudinal axis of said tube;

a corresponding opening in said continuous fin strip adjacent to said winglet, said corresponding opening having a smallest-angle corner.

3. The method of claim 2, wherein:

said generally triangular shape is a right triangle;

said winglet has a smallest edge extending generally perpendicularly from said front surface of said continuous fin strip, said smallest edge having a height;

said folded edge of said winglet has a length which is approximately four times said height;

said winglet is positioned such that a first angle between a line parallel to said radial axis and said folded edge is approximately 45 degrees;

said smallest-angle corner is positioned such that a second angle between said radial axis and a line from said smallest-angle corner to the intersection of said radial axis and said central longitudinal axis is approximately 67.5 degrees.

4. The method of claim 2, wherein:

each of said 360-degree section of said continuous fin strip is spaced apart a distance;

said winglet has a smallest edge extending generally perpendicularly from said front surface of said continuous fin strip, said smallest edge having a height; and said height is approximately 0.9 times said distance such that each of said vortex generators is adjacent to a rear surface of said fin strip, said rear surface being opposite to said front surface.

* * * * *